US006118381A

United States Patent [19]

James

[11] Patent Number: 6,118,381

[45] Date of Patent: Sep. 12, 2000

[54] FIRE DETECTION INCLUDING AN AIR MOVEMENT DEVICE AND PRE-CONDITION SENSING

[75] Inventor: Robert Wilton James, Crafers, Australia

[73] Assignee: FF Seeley Nominees Pty. Ltd., Australia

[21] Appl. No.: 09/256,863

[22] Filed: Feb. 24, 1999

[30] Foreign Application Priority Data

Feb. 24, 1998 [AU] Australia ..... PP 1999

[51] Int. Cl.[7] ..... G08B 17/12

[52] U.S. Cl. ..... 340/577; 340/578; 340/579; 340/628; 340/584; 340/648

[58] Field of Search ..... 340/577, 578, 340/579, 628, 584, 648, 662, 660, 664

[56] References Cited

U.S. PATENT DOCUMENTS

| | | | |
|---|---|---|---|
| 4,063,595 | 12/1977 | Phillips | 169/60 |
| 4,496,817 | 1/1985 | Smith | 219/10.55 |
| 4,818,970 | 4/1989 | Natale et al. . | |
| 5,260,691 | 11/1993 | Shyu | 340/589 |
| 5,471,359 | 11/1995 | Simpson et al. . | |

*Primary Examiner*—Jeffery A. Hofsass
*Assistant Examiner*—Hung Nguyen
*Attorney, Agent, or Firm*—Watts, Hoffmann, Fisher & Heinke Co., L.P.A.

[57] ABSTRACT

A system for the detection of fire in an apparatus or device having a fan and a pump, comprising means 20, 25 for detecting the presence of a pre-condition of fire, control means 30 for deactivating the fan on detection of said precondition, and fire detector means 35 for detecting smoke or fire in the absence of air movement.

11 Claims, 2 Drawing Sheets

FIRE DETECTION INCLUDING AN AIR MOVEMENT DEVICE AND PRE-CONDITION SENSING

FIELD OF THE INVENTION

The present invention relates to a system and method for detecting fire or a condition likely to result in fire in an apparatus or device having an air movement device. In particular, the present invention is highly suited for use in domestic appliances such as air conditioners or transport vehicles wherein it is desired to detect a fire by the presence of smoke particles.

BACKGROUND OF THE INVENTION

With a greatly expanding use of plastics materials as a substitute for metals in the manufacture of housings, containers and components of machines there arises a prevalence of polymer based fires when such components are ignited thus providing an added danger.

Fire retardants can be added to plastics materials but the service life of those retardants is often substantially less than the service life of the plastics component. Typical fire retardants are relatively volatile and vaporise from the plastics material over time. When plastics materials are exposed to heat they can ignite and/or melt releasing toxic volatiles and exhibiting problems associated with polymer based fires.

A further complicating aspect of this problem is the difficulty in detecting the presence of a fire. Various types of sensors and detectors are available for detecting the presence of a fire. However, the applicant required the presence of a fire to be detected in an environment of relatively high velocity air currents. This type of environment is predominant in air conditioning housings and in particular evaporative air coolers. As this type of cooler depends upon the generation of high velocity air currents for the supply of large volumes of air, it presents a difficulty for the detection of fire.

Various detectors and sensors are available for detecting fires which are considered to be the most appropriate for this type of environment such as infra red sensors, ultra violet sensors and visible light sensors. In addition, there are also commercially available thermal detectors. However, the applicant discovered significant disadvantages with each of the various types of detectors generally recommended for the target environment. These disadvantages were primarily the relatively high cost for the various types of radiation detectors and the restricted scope of detection of thermal detectors (i.e. detection only for regions in close proximity of the detector). Additionally, various problems were encountered with the use of radiation detectors in relation to false alarm due to leakage of outside light into the housing of the air conditioners. Also, to provide adequate coverage of the entire unit to be protected, numerous of these detectors were required which adds significantly to the cost of the apparatus.

Whilst one of the simplest and probably the least expensive type of detector for the detection of a fire is a standard domestic smoke detector, the applicant soon discovered that this type of detector was not able to be employed successfully in environments comprising high velocity air currents. The difficulty of detecting the presence of small quantities of smoke in a fast moving air stream is well known, and numerous devices have been developed in attempts to address this problem.

Use of all types of smoke detectors proved to be ineffective as the smoke particles were so diluted in the air stream that they did not occur in sufficient concentration to insure effective detection by the smoke detector. In addition, the high velocity air currents also act to degrade the sensitivity of the smoke detectors.

Various configurations of smoke detectors were attempted and tested with smoke sources including the positioning of numerous detectors in and around various locations of the air conditioner and the installation. In one configuration, a smoke detector was installed in the housing of the cooler with a second detector located downstream within one of the air conditioning ducts. Even with this configuration, the dilution of smoke particles in the ducting was sufficient to render the smoke detector incapable of detecting their presence in sufficient concentration.

SUMMARY OF THE INVENTION

The present invention provides a system for the detection of fire or of a condition likely to result in fire in an apparatus or device having an air movement device for creating an air stream in said apparatus, comprising means for detecting the presence of at least one pre-condition of fire or of a condition likely to result in fire, control means for causing deactivation of said air movement device on detection of the or each pre-condition, and means for detecting a condition indicating fire or a condition likely to result in fire in the absence of said air stream.

The present invention also provides a method of detecting a fire condition in an apparatus or device having an air movement device, including the steps of detecting at least one pre-condition likely to result in a fire, causing deactivation of said air movement device in response to said detected pre-condition, detecting a condition indicating fire or a condition likely to result in fire, and generating a signal indicating the presence of a fire.

Even though the present invention will be described in relation to fire detection in air conditioning equipment, it will be appreciated that in its broadest form it is not limited to this specific application.

BRIEF DESCRIPTION OF THE DRAWINGS

The present invention will be now be described by way of example with reference to the accompanying drawings in which.

DESCRIPTION OF THE PREFERRED EMBODIMENT

Figure 1:
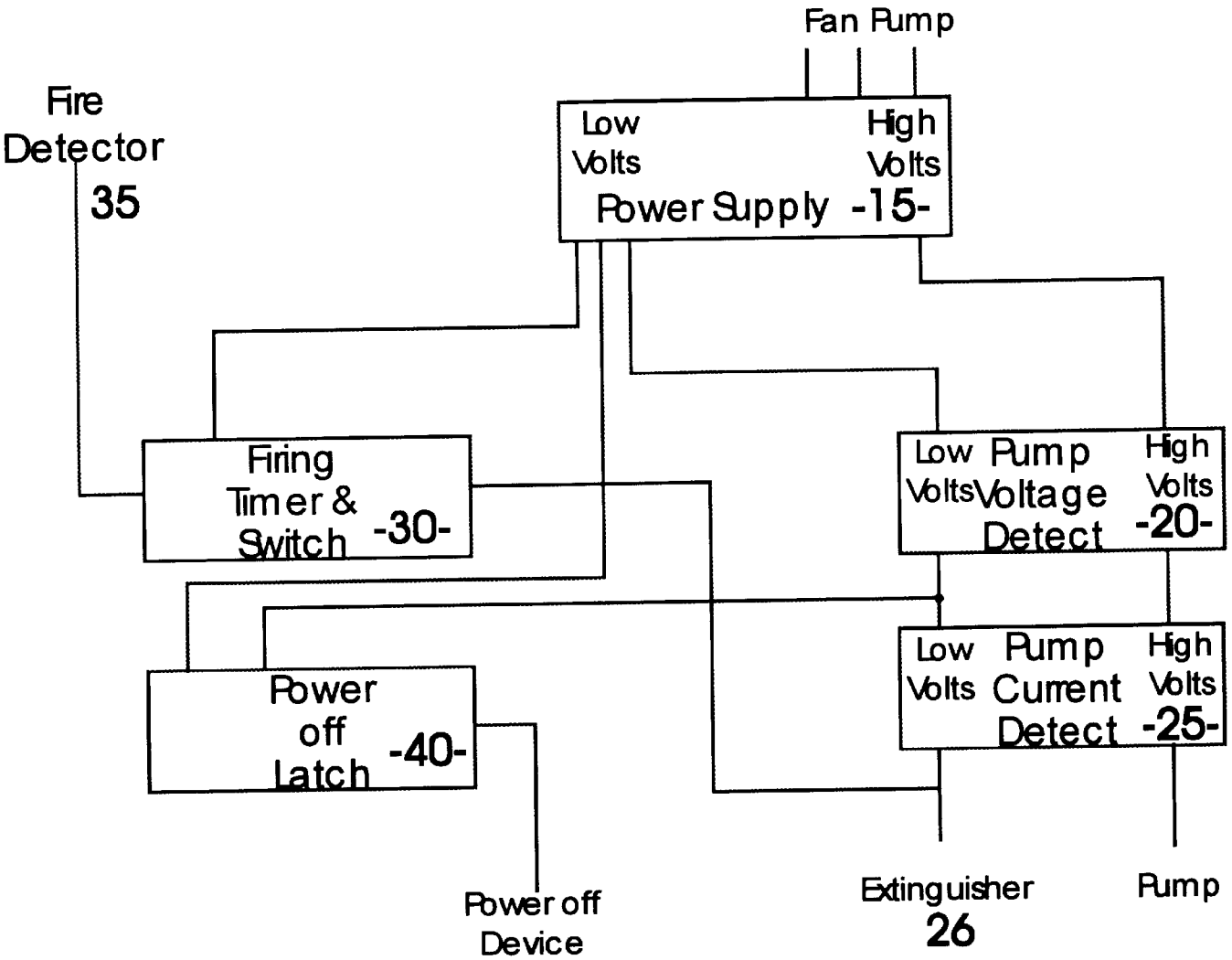
FIG. 1 shows a schematic outline of one embodiment of the invention.

In FIG. 1, the fire detection control circuitry comprises various functional blocks which are identified as power supply circuitry 15, pump voltage detect circuitry 20, pump current detect circuitry 25, fire signal driver circuitry 30, smoke detector output driver circuitry 35 and fan shutdown latch circuitry 40.

The power supply circuitry 15 provides the remainder of the fire detection control circuitry with direct current power based upon the supply of alternating current power from any one of the power supply lines indicated by Pump or Fan. The Fan may have two or more speed settings, any one of which may supply alternating current power to the power supply.

One of the primary sources of a fire condition within an evaporative air cooler is the water pump which recirculates water from the tank of the cooler through the pads. It has been known for these pumps to fuse and overheat. The generation of sufficient heat has been known to cause the plastic casing of certain pumps to ignite and hence become a source of fire that could spread to the remainder of the flammable cooler components. The pump voltage detect circuitry 20 and the pump current detect circuitry 25 act to detect the supplied voltage and current to the pump respectively. The output of each of these circuits is separated from the high voltage mains power by, for example, optically isolated integrated circuit electronic devices. The output signals from these optical isolating devices are connected in series such that the current through one must flow through the other in order to flow through the device used to initiate the extinguisher 26. Such a device could be, for example, an electric detonation device which, prior to detonation presents a substantially zero impedance to ground potential.

The electrical signal between the low voltage sides of the pump voltage detect circuitry 20 and the pump current detect circuitry 25 represents a logical "and" of the outputs. With an active signal from both of these sensing circuits indicating that both a voltage and a current has been detected, a low voltage results at the output of the Pump Current Detect module 25. This signal is connected to the Power off latch circuitry 40 and whilst remaining at a low voltage, the Power off latch circuitry does not deactivate the Cooler. It will be noted by those skilled in the art that some diode logic will be required to ensure that this signal is not passed to either the fire signal driver circuitry 30 or the smoke detector output driver circuitry 35.

In the event of a fault condition in the pump, which in turn becomes a pre-condition for the system, a high voltage results at the output of the Pump Current Detect module 15. This high voltage signal is supplied to the input of the fan shutdown latch circuitry 40 which in turn switches off all power to the Cooler.

Those skilled in the art will recognise that an electrical fault in a pump motor, which may result in a fire, could manifest itself as either an open circuit of the motor windings, or a short circuit within the motor windings, or to ground. If the pump suffers a short circuit condition, this will only be temporary and the drawing of excessive current will ultimately lead to an open circuit condition. In this particular situation, the pump circuitry would eventually become open circuit. Thus, a fire in a pump will inevitably lead to an open circuit condition in the pump circuitry, and the sensing circuitry would then indicate a voltage present in the absence of a pump current. In this situation, while the Pump Voltage Detect section 20 can conduct a current, the Pump Current Detect section 25 cannot. The voltage between the Pump Voltage Detect section 20 and Pump Current Detect section 25 will therefore rise providing an input to the Power off Latch 40 and hence the power to the Cooler will be shut down.

As the pump device may be switched independently and the cooler operated without the pump running, it will be noted that a condition wherein neither a pump voltage nor a pump current is detected is an allowable condition.

In this particular embodiment, the use of the extinguisher 26 as the ground return for the logical "anding" of the signals from the pump voltage sense circuitry and the pump current sense circuitry has the added beneficial effect of indicating an open circuit malfunction of the detonator in addition to the indication of a pump malfunction. For example, if the extinguisher has not been connected or for some reason wiring to the detonator has become open circuit, a high voltage results at the junction between the Pump Voltage Detect section 20 and Pump Current Detect section 25 which is the same as for a pump malfunction and hence the Power off latch circuitry 40 is activated and the Cooler is shut down. This enables the Cooler to be shut down on the basis of a malfunction indication from the extinguishing system itself.

The fan shut down latch circuitry 40 of the embodiment of FIG. 1 receives an output signal from the junction of the Pump Voltage Detect section 20 and Pump Current Detect section 25, and both latches the signal and drives a device for shutting off the power, which may be a relay or thermal actuator by way of example. In this particular embodiment, the thermal actuator opens the contacts of a power switch thereby disconnecting power to all sources of air movement devices in the unit. It will be recognised by those skilled in the art that this section of the circuitry could easily be replaced with a switching device for disconnecting power to the air movement devices separately. The thermal actuator in this embodiment opens the contacts of the main power switch and the power switch remains in this condition until it is closed by an operator. It will also be noted that a temporary disconnection of supply to the air movement devices could be incorporated which would still allow improved detection of smoke particles by a detector with re-connection of the air movement devices after a sufficient time in the event of a nil detection of smoke particles.

Upon de-activation of the air movement devices, a fire detector (not detailed in FIG. 1) is able to better detect the presence of fire by means of smoke detection or other means. The output of the fire detector is provided as an input to the smoke detector output driver circuitry 35. This circuitry depicted schematically in the embodiment of FIG. 1 requires that the signal from the smoke detector is present for a sufficient time to provide extra confidence that the system will not indicate a fire condition in the event of a false or nuisance detection by the smoke detector. In addition, this circuitry also drives the input of the fire signal driver circuitry 30 which provides sufficient power to operate the extinguisher.

In this particular embodiment, the fire detection signal is passed directly to a matchhead detonator. The matchhead detonator upon exploding causes the release of a pressurised fluid which in turn expels a fire retardant fluid throughout the air conditioner housing.

However, these aspects of this particular embodiment will be well understood by persons skilled in the art, and are not described in detail in this specification It will be noted that the output signal of the fire signal driver circuitry 30 could also be provided to a alarm sounding device or some other type of indication means. In the embodiment of FIG. 1, it is considered that the cessation of operation of the cooler will be sufficient indication to the user that a fault condition has occurred. In the event of smoke detection and firing of the extinguishing system, it will be immediately apparent to a user of the cooler that this system has been deployed and will require re-initialisation including refilling of the extinguishing apparatus with fluid.

Although the current and voltage sensing of FIG. 1 is limited to the operation of the pump motor, it will be noted by those skilled in the art that this sensing technique could be equally applied to the motors of the air movement devices as they are also a primary source of fire condition in the cooler.

Figure 2:
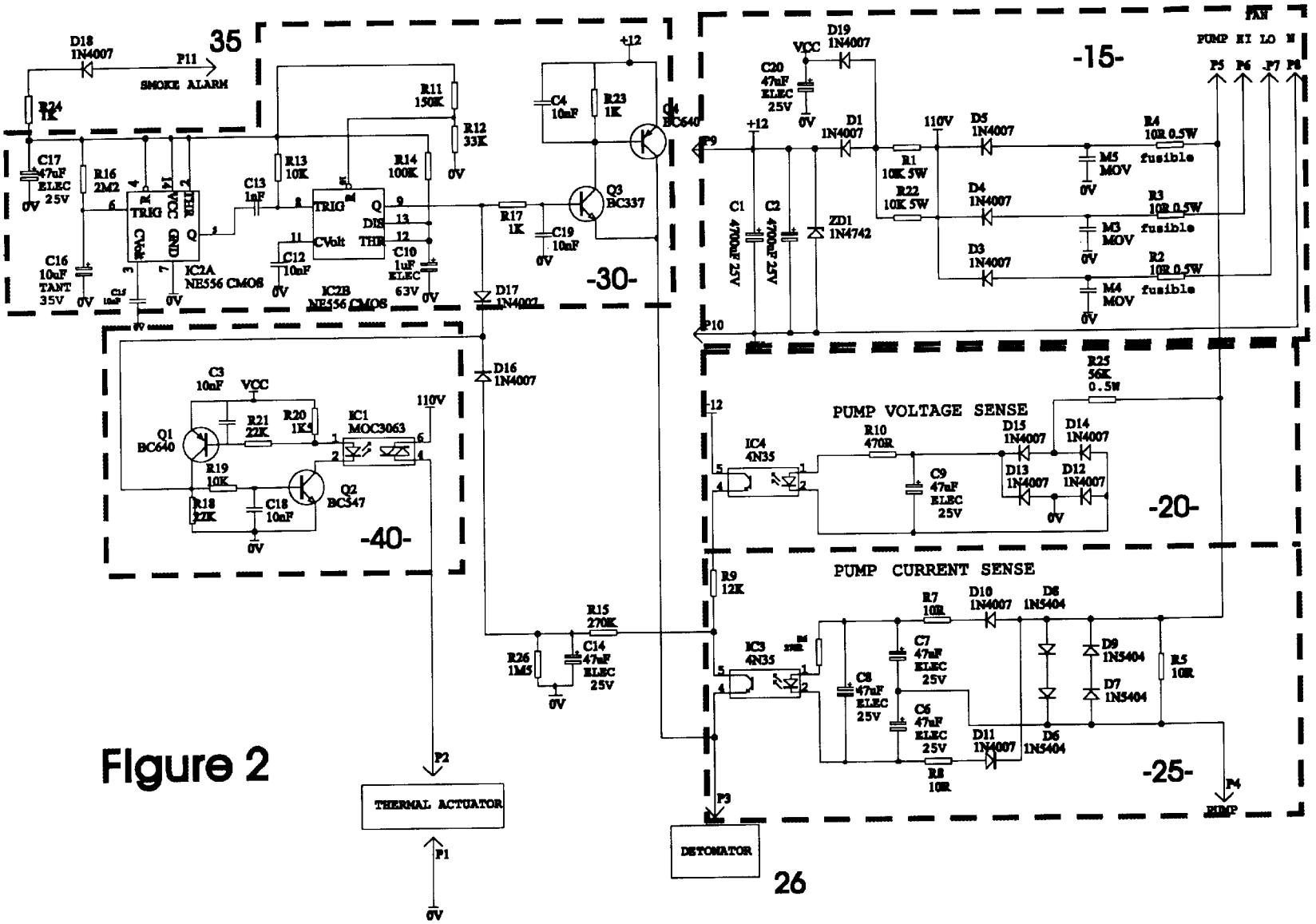
FIG. 2 is a circuit diagram of one specific implementation of the embodiment of FIG. 1.

FIG. 2 illustrates an electronic schematic of one embodiment of the invention. In this drawing, the various functional blocks have been identified in dashed outline and numbered in accordance with the blocks as depicted in FIG. 1. It will be apparent to those skilled in the art that there is additional detail required in the design of the electronics in order for the functional depiction of FIG. 1 to operate as a practical design, and FIG. 2 illustrates an embodiment that includes all such detail in a manner which will be understood by skilled persons without detailed description.

In addition to the potential fire sources already indicated, various other potential sources exist These include electrical junction boxes and other electrical devices which do not incorporate an electrical motor. For these locations, where excessive heat conditions could cause a fire, thermal detectors can be located inside the device which act to disconnect supply to the air movement devices in the event of actuation. These detectors effectively provide alternative pre-conditions which could result in a fire condition.

Accordingly, as will be noted by those skilled in the art, this invention reduces the difficulties of using smoke detectors for the detection of fire in environments comprising high velocity air currents. In particular, this invention enables the use of relatively inexpensive domestic smoke detectors to detect the presence of a fire. The detection of pre-conditions, resulting from the sensing of fault conditions in the primary potential sources of fire, and the shutdown of the air movement devices allows the improved operation of the smoke detector and hence detection of a fire condition within the apparatus.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A system for the detection of fire or of a condition likely to result in fire in an apparatus or device having an air movement device for creating an air stream in said apparatus, comprising means for detecting the presence of at least one pre-condition of fire or of a condition likely to result in fire, control means for causing deactivation of said air movement device on detection of the or each pre-condition, and means for detecting a condition indicating fire or a condition likely to result in fire in the absence of said air stream and generating a signal and indicating the presence of a fire.

2. The system of claim 1, wherein said apparatus includes an electric motor, said pre-condition being indicated by the presence of a predetermined voltage and/or current in a motor winding of said electric motor.

3. The system of claim 2, wherein said pre-condition is indicated by the presence of a predetermined voltage together with the substantial absence of current in said motor winding.

4. The system of any preceding claim, further including a fire extinguishing means activated by said means for detecting said condition indicating fire.

5. The system of claim 4, wherein said fire extinguishing means is activated by an electric current and said means for detecting the presence of at least one pre-condition is adapted to operate in the absence of electric current to said fire extinguishing means, whereby said air movement device is unable to operate in the absence of a connection to said fire extinguishing means.

6. The system of any preceding claim, wherein said control means for causing deactivation of said air movement device causes deactivation of power to the air movement device or to the entire apparatus or device.

7. The system of any preceding claim in which the apparatus or device to be protected is an evaporative air cooler, and said pre-condition is detected by detecting a predetermined voltage and/or current in a motor used to drive a pump for said air cooler or a motor used to drive a fan for said air cooler.

8. A method of detecting a fire condition in an apparatus or device having an air movement device, including the steps of detecting at least one pre-condition likely to result in a fire, causing deactivation of said air movement device in response to said detected pre-condition, detecting a condition indicating fire or a condition likely to result in fire, and generating a signal indicating the presence of a fire.

9. The method of claim 8, wherein said apparatus includes an electric motor, said pre-condition being indicated by the presence of a predetermined voltage and/or current in a motor winding of said electric motor.

10. The method of claim 9, wherein said pre-condition is indicated by the presence of a predetermined voltage together with the substantial absence of current in said motor winding.

11. The method of claim 8, 9 or 10, wherein said signal indicating presence of a fire activates a fire extinguishing means.

* * * * *